US005271298A

United States Patent [19]

Gazel-Anthoine

[11] Patent Number: 5,271,298

[45] Date of Patent: Dec. 21, 1993

[54] APPARATUS FOR CONNECTING AND DISCONNECTING PIPE CONNECTION OF A DRILLING STRING

[76] Inventor: Gilles Gazel-Anthoine, 18 Rue Martignon, 92500 Rueil Malmaison, France

[21] Appl. No.: 913,434

[22] Filed: Jul. 15, 1992

[30] Foreign Application Priority Data

Jul. 23, 1991 [FR] France ..... 91 09272

[51] Int. Cl.[5] ..... B25B 17/00

[52] U.S. Cl. ..... 81/57.16; 81/57.2; 81/57.34

[58] Field of Search ..... 81/57.11, 57.14, 57.16, 81/57.2, 57.3, 57.33, 57.34, 186

[56] References Cited

U.S. PATENT DOCUMENTS 2,263,267 11/1941 Franklin ..... 81/57.16
3,246,547 4/1966 O'Neill et al. .
3,540,326 11/1970 Dickmann et al. .
4,372,026 2/1983 Mosing .
4,485,697 12/1984 Heilhecker et al. .
5,067,376 11/1991 Fosella ..... 81/186 X

FOREIGN PATENT DOCUMENTS 0082098 6/1983 European Pat. Off. .
3306809 7/1984 Fed. Rep. of Germany .
2137546 10/1984 United Kingdom .

*Primary Examiner*—James G. Smith
*Attorney, Agent, or Firm*—Young & Thompson

[57] ABSTRACT

A machine for screwing and unscrewing two rods comprises an annular carcass (11) forming a frame about a central axis (A) and, staggered in height on said carcass (11), upper and lower wrenches (12E, 12I) each adapted to grip two successive rods (13). One of said wrenches (12E), referred to hereinafter as the drive wrench, is mounted rotatably relative to the carcass (11) and said drive wrench (12E) at least comprises a plurality of cams (18) distributed circumferentially and each mounted to pivot about an axis (A') parallel to the central axis (A) between a retracted position in which they leave around said central axis (A) a space (19) sufficient for the rods (13) to pass through and a deployed position in which they intrude on said space (19) and are able conjointly to grip a rod (13) present in the latter. The machine is useful in drilling installations.

25 Claims, 2 Drawing Sheets

APPARATUS FOR CONNECTING AND DISCONNECTING PIPE CONNECTION OF A DRILLING STRING

FIELD OF THE INVENTION

The present invention is generally concerned with screwing together and unscrewing rods which, when they are used (as in the case of drill rods, for example) are assembled together in succession into a string, their ends being screwthreaded for this purpose.

BACKGROUND OF THE INVENTION

In practice any two consecutive rods are usually screwed together in two stages.

In a first stage one is simply rotated relative to the other by a sufficient number of turns for their ends to be correctly engaged with each other.

In a second stage they are locked together by the application of a certain torque between them over a fraction of a turn.

Similarly, they are unscrewed in two stages.

At present different means are usually employed for each of the two operations that are needed.

For the rotation stages these means comprise a chain, for example, of which several turns are passed around one of the rods whilst the other is immobilized. The chain is connected to a capstan so that traction can be applied to it.

The fitting and use of the chain are relatively difficult, time-consuming and dangerous.

Virtually the same can be said of the alternative situation in which a motor-driven chain is merely passed around one rod in a U-shape.

For the locking and unlocking stages a wrench which grips one of the rods between two jaws, the other being immobilized, is usually employed at present.

Screwing and unscrewing machines achieving some degree of mechanization of these two operations have already been proposed.

All have the common drawback of needing to be removed from the workstation when the rods have been screwed together or unscrewed to enable further operations to be carried out on the rods.

Otherwise the lifting device usually employed for these operations is prevented from reaching the rods on which it is to operate.

It is therefore necessary with currently known screwing and unscrewing machines to place the machine around the rods, to carry out the required screwing or unscrewing and then to remove the machine.

Apart from the fact that to enable it to be fitted and removed a screwing and unscrewing machine of this kind must almost inevitably be in two parts adapted to open relative to each other facing the string of rods to be processed, which results in some complexity of construction, these repetitive operations of fitting and removing the machine compromise productivity.

SUMMARY OF THE INVENTION

A general object of the present invention is a screwing and unscrewing machine adapted to remain at the workstation permanently, at least for the routine operations of screwing and unscrewing a string of rods, which is advantageously free of this drawback and has further advantages.

This screwing and unscrewing machine is generally characterized in that it comprises an annular carcass forming a frame about a central axis and, staggered in height on said carcass, upper and lower wrenches each adapted to grip two successive rods, in that one of said wrenches, referred to hereinafter as the drive wrench, is rotatable relative to the carcass and in that said drive wrench at least comprises a plurality of cams distributed circumferentially and each mounted to pivot about an axis parallel to the central axis between a retracted position in which they leave around said central axis a space sufficient for the rods to pass through and a deployed position in which they intrude on said space and are able conjointly to grip a rod present in the latter.

The space that is released by these cams when they are in the retracted position provides access to the string of rods, which advantageously enables the screwing and unscrewing machine to remain at the workstation between two uses.

In other words, the screwing and unscrewing machine in accordance with the invention always remains and is always used at the same location, which is beneficial to productivity.

Drive means are naturally associated with the cams of the drive wrench for urging them from their retracted position to their deployed position.

These drive means comprise a sufficient number of motor-gearbox units, for example.

Be this as it may, as a result of the action of said drive means the cams of the drive wrench close in a first stage onto the rod to be screwed or unscrewed and rotate the rod during a second stage.

For rods of a standard type, at least, the drive means associated with the cams of the drive wrench are sufficient in themselves to screw and then lock the rod or release and then unscrew it.

For other types of rod, however, the torque generated by these drive means may be insufficient for locking or releasing the rod.

Additional ratchet type drive means are therefore further provided in the screwing and unscrewing machine in accordance with the invention for locking or unlocking the rods. However, in both cases this screwing and unscrewing machine is advantageously adapted to carry out these two operations of screwing and locking or unlocking and unscrewing on its own, which benefits productivity.

In essence, the screwing and unscrewing machine in accordance with the invention advantageously provides precise and comprehensive mechanization of the two operations to be effected, with a substantial improvement in productivity.

BRIEF DESCRIPTION OF THE DRAWINGS

The features and advantages of the invention will emerge from the following description given by way of example with reference to the appended diagrammatic drawings in which.

DETAILED DESCRIPTION OF THE INVENTION

Figure 1:
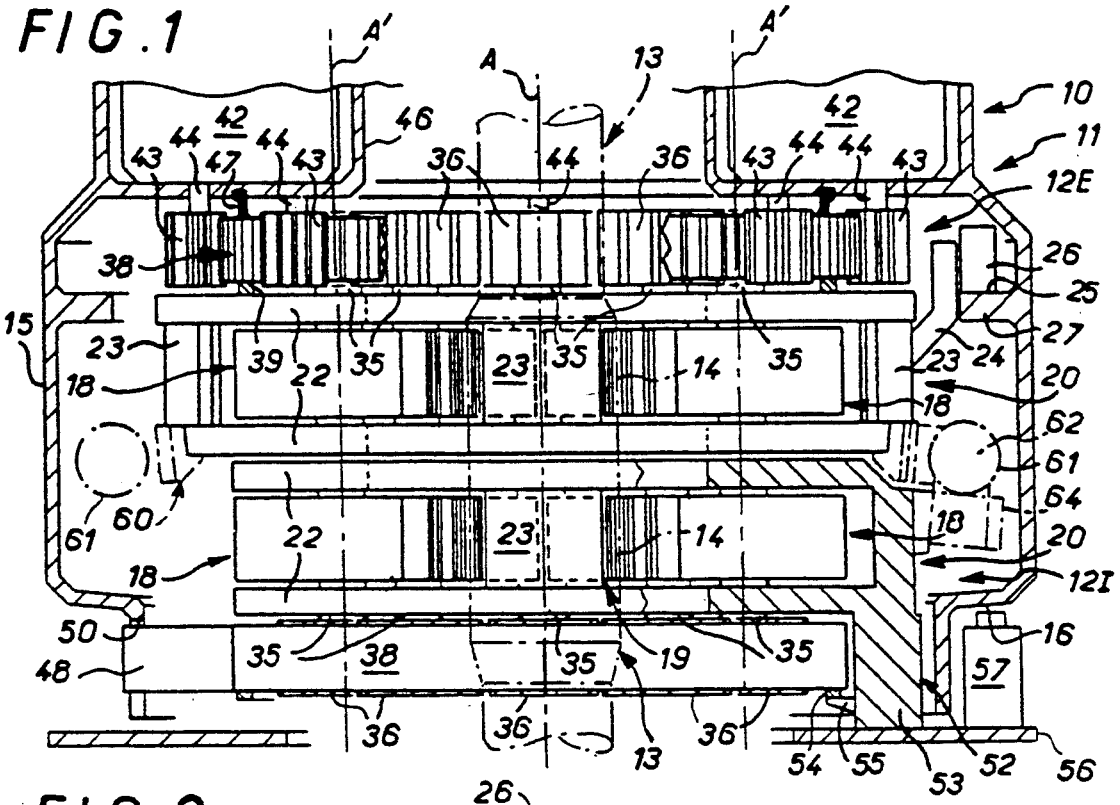
FIG. 1 is a locally cut away partial side view in axial cross-section of the screwing and unscrewing machine in accordance with the invention.

As shown in the figures, the screwing and unscrewing machine 10 in accordance with the invention comprises, annularly disposed around a central axis A, a carcass 11 forming a frame and at different heights in said carcass 11 two wrenches 12E, 12I, one at the top and the other at the bottom, each adapted to grasp a respective one of two consecutive rods 13 in a manner to be described in more detail later and as shown in chain-dotted lines in FIG. 1.

Because the rods 13 are well known in themselves and are not part of the present invention they will not be described here.

They are drill rods, for example, and suffice to say that, adapted to be assembled end to end in pairs by screwing, each has an enlarged portion 14 at each end and screwing and unscrewing are performed on this enlarged portion 14.

In the embodiment shown the carcass 11 of the screwing and unscrewing machine 10 in accordance with the invention is generally barrel-shape with a central enlarged portion 15 defining a transverse annular shoulder 16 at its lower end for reasons that will emerge later.

One of the wrenches 12E, 12I, in this example the wrench 12E which will be referred to hereinafter for convenience only as the drive wrench, is rotatable relative to the carcass 11 about the central axis A. The other wrench 12I, which will be referred to hereinafter for convenience only as the immobilizer wrench, is fastened to a fixed support baseplate 56, for example, as shown here.

In the embodiment shown the drive wrench 12E is in practice the top wrench and the immobilizer wrench 12I is the bottom wrench.

Figure 2:
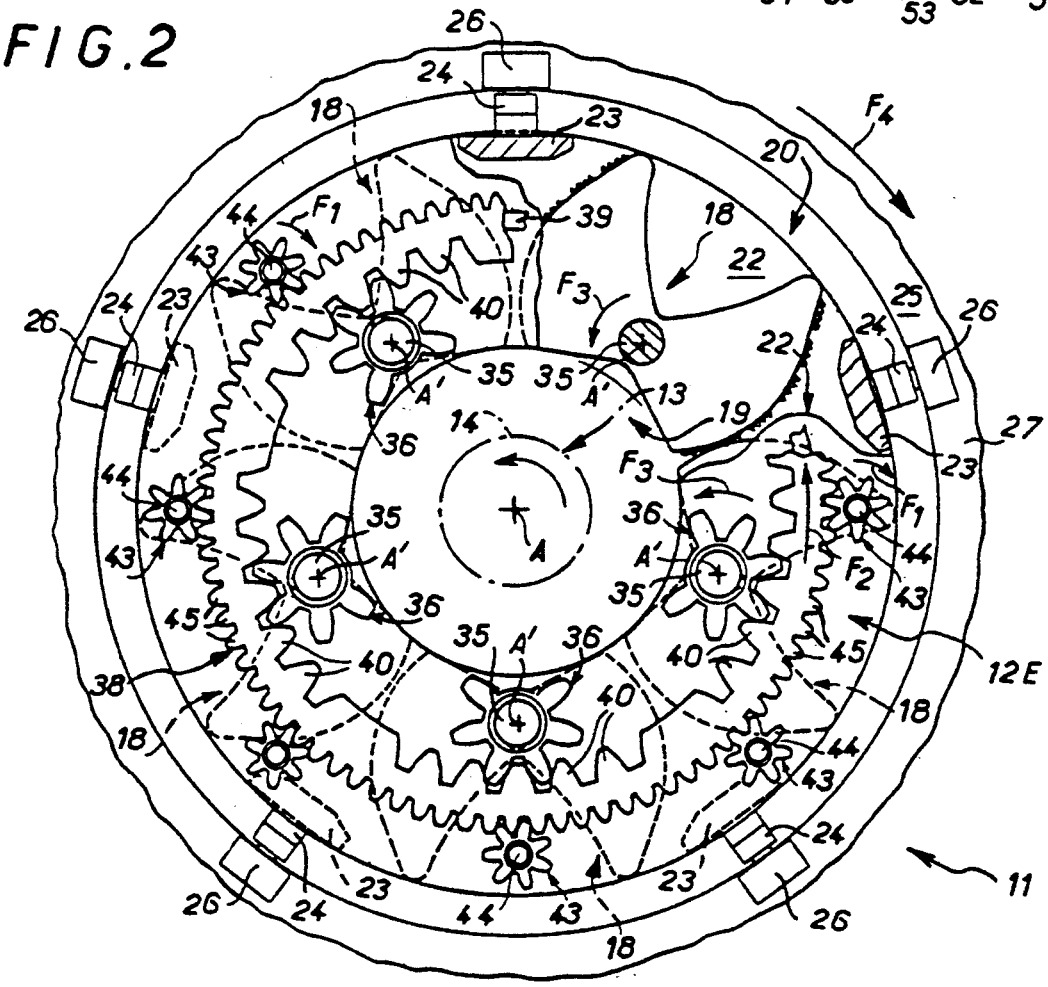
FIG. 2 is a locally cut away partial top view of it as seen in the direction of the arrow II in FIG. 1 with the cams that it comprises in the retracted position.
Figure 4:
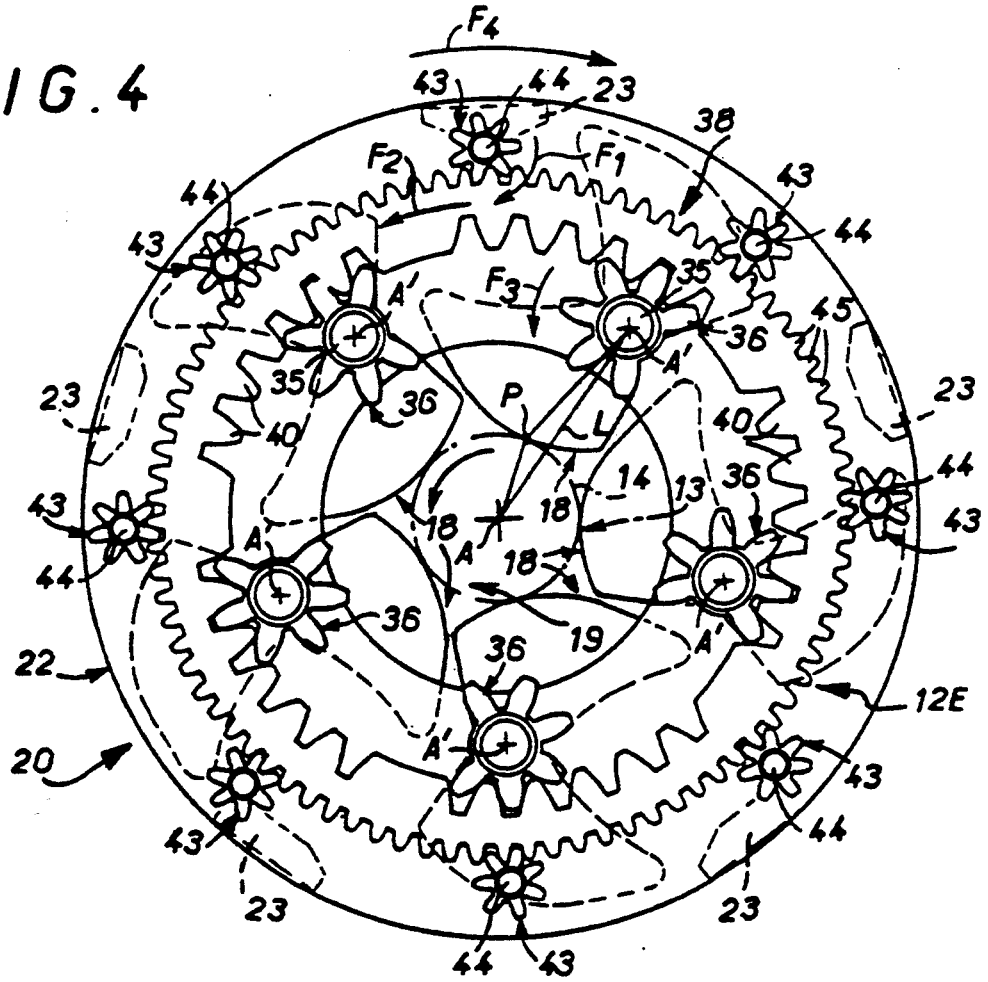
FIG. 4 is a partial top view similar to that of FIG. 1 with the cams in a deployed position.

The drive wrench 12E at least comprises a plurality of cams 18 disposed circumferentially around the central axis A. Each pivots about a respective axis A' parallel to the central axis A between a retracted position in which, as shown in FIG. 2, it leaves a sufficient free space 19 around the central axis A for the rods 13 to pass through, including their enlarged portions 14, together with the various tools that may be fitted to the respective string of rods and the lifting device required to manipulate it, and a deployed position in which they intrude on this space 19, as shown in FIG. 4, and are able to grip conjointly the periphery of the enlarged portion 14 of a rod 13 present in the space 19.

In the embodiment shown there are five cams 18 equi-angularly spaced around the central axis A.

They are carried by an armature 20.

In the embodiment shown this armature 20 is in the form of two spaced parallel annular plates 22 disposed transversely to the central axis A, held apart by uprights 23 and with the cams 18 disposed between them.

As shown here, for example, five uprights 23 extend between the plates 22, near their outside edge.

In the case of the drive wrench 12E the resulting armature 20 is rotatable in the carcass 11.

In the embodiment shown the armature 20 accordingly has a plurality of peripheral arms 24 through which it is adapted to bear rolling fashion on an annular shoulder 25 of the carcass 11.

As shown here, for example, five arms 24 are provided at the outside edge of the top plate 22 on each of which is rotatably mounted a respective roller 26 and the corresponding annular shoulder 25 of the carcass 11 is part of a flange 27 projecting transversely from the inside surface of the central enlarged portion 15 of the carcass 11.

Figure 3:
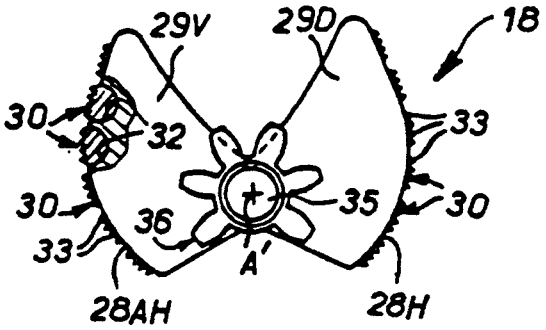
FIG. 3 is a locally cut away top view to a larger scale of one of these cams shown on its own.

In the embodiment shown, and as is more clearly visible in the case of one of them in FIG. 3, each of the cams 18 has two symmetrical profiles 28H, 28AH, the first for clockwise driving and the second for anticlockwise driving.

The profiles 28H, 28AH are in practice formed by the edge of two flanges 29H, 29AH and each is such that, whatever the diameter of the rod 13 to be gripped, their point of contact P with the rod is near the center line L joining the central axis A to the respective pivot axis A', so as to achieve some degree of cross-bracing when screwing and unscrewing.

As shown, each of the cams 18 preferably has along each of its profiles 28H, 28AH a plurality of jaws 30 pivoting about axes parallel to its own pivot axis A'.

As can be seen for some of them in FIG. 3 by virtue of this figure being partially cut away, the jaws 30 which are disposed on generatrices of the respective profile 28H, 28AH have a circular transverse cross-section subtending an angle of slightly more than 180°, for example, and they pivot in complementary housings 32 recessed for this purpose into the profiles 28H, 28AH. They are retained at their ends to the cam 18 which carries them, for example by means of plates (not shown in the figures) attached to the latter for this purpose.

The jaws 30 have external teeth or ribs 33 along their generatrices to improve their grip on the rod 13.

Their capacity for pivoting in their housing circuit 2 favors their fitting to the rod 13.

Each of the resulting cams 18 is constrained to rotate with a shaft 35 extending along its pivot axis A' from one plate 22 of the armature 20 to the other, being rotationally coupled to the latter.

Through a gear 36 constrained to rotate with the shaft 35 it meshes with a synchronizer ring 38 disposed annularly around the central axis A and common to all the cams 18.

In the embodiment shown and for reasons that will emerge later at least one tooth of the gear 36 is missing.

The synchronizer ring 38 is outside the armature 20, above its top plate 22, the shaft 35 of the cams 18 being extended for this purpose.

It is therefore disposed beside the drive wrench 12E facing the immobilizer wrench 12I.

To support it the top plate 22 of the armature 20 has a projecting annular ring 39 around the central axis A.

The synchronizer ring 38 surrounds all of the gears 36 and has on its inside edge at the location of each of the gears 36 a succession of teeth 40 for meshing with the gears.

The number of the teeth 40 is sufficient to move the cams 18 from their retracted position to their deployed position.

Drive means are naturally associated with the cams 18 for urging them from this retracted position to the deployed position.

In the embodiment shown these drive means comprise a plurality of motor-gearbox units 42 distributed around the central axis A, carried by the carcass 11 and which each mesh through a gear 43 constrained to rotate with their output shaft 44 with the outside edge of their synchronizer ring 38 which is provided with continuous teeth 45 for this purpose.

It follows from the above description that in the embodiment shown the motor-gearbox units 42 are on the side of the drive wrench 12E opposite the immobilizer wrench 12I.

They are disposed in an annular housing 46 provided for this purpose in the upper part of the carcass 11.

As shown here, for example, there are eight motor-gearbox units 42 equi-angularly distributed about the central axis A.

A seal 47 is provided on the lower surface of the housing 46 between the latter and the synchronizer ring 38.

This is a lip seal, for example.

The second wrench 12I referred to hereinafter for convenience only as the immobilizer wrench is generally similar to the driver wrench 12E.

Thus, like the latter, it comprises cams 18 pivotally mounted on an armature 20 formed by two plates 22 and these cams 18 mesh with a synchronizer ring 38 through a gear 36 keyed to their shaft 35.

Differing from the previous arrangements, however, this synchronizer ring 38 is constrained to rotate with the carcass 11.

To achieve this the synchronizer ring 38 has on its outside periphery, instead of the previously described teeth 45, a plurality of radially projecting fingers 48 (five of them, for example) engaged with slots 50 provided for this purpose in the carcass 11, at its base, parallel to the central axis A.

The height of the slots 50 is sufficient to enable some axial movement of the carcass 11 relative to the immobilizer wrench 12I for reasons that will be explained later.

In the embodiment shown the immobilizer wrench 12I (which is the bottom wrench, as explained previously) comprises on the bottom surface of its bottom plate 22 a mount 52 by which it is fastened to the supporting baseplate 56.

As shown here, for example, the mount 52 is made up of a plurality of feet 53 equi-angularly distributed around the central axis A.

In the embodiment shown the synchronizer ring 38 of the immobilizer wrench 12I is supported by a ring 54 carried by brackets 55 projecting for this purposes from the interior surface of each of the feet 53 constituting the mount 52.

Furthermore, in this embodiment, the supporting baseplate 56 comprises externally of the carcass 11 and at the location of the transverse shoulder 16 of the latter a plurality of jacks 57 equi-angularly distributed around the central axis A and adapted to act on the carcass 11.

Finally, in the embodiment shown, ratchet type drive means are provided between the two wrenches 12E, 12I.

Figure 5:
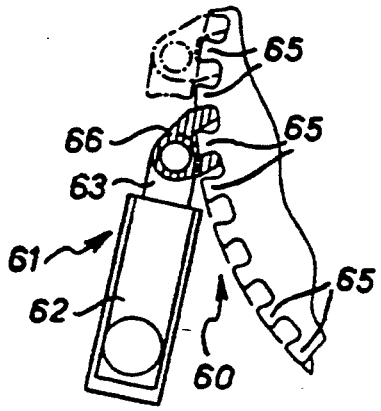
FIG. 5 is a partial top view in cross-section to a larger scale showing ratchet type drive means conjointly employed in the screwing and unscrewing machine in accordance with the invention.

As shown in FIG. 5, for example, these drive means comprise a toothed wheel 60 fastened to the armature 20 of one of the wrenches 12E, 12I and at least one jack 61 either the cylinder 62 or the piston 63 of which is articulated to the armature 20 of the other wrench 12E, 12I and the other part of which (the piston 63 or the cylinder 62) is adapted to mesh with the toothed wheel 60.

In the embodiment shown and as diagrammatically represented in chain-dotted line in FIG. 1, the toothed wheel 60 is operative at the edge of the bottom plate 22 of the drive wrench 12E and the jack 61 is articulated by its cylinder 62 to a bracket 64 fastened to the armature 20 of the immobilizer wrench 12I.

It is therefore the piston 63 of this jack 61 that meshes turn and turn about with the teeth 65 of the toothed wheel 60.

For this meshing engagement the piston 63 carries a rotatable skid 66 in the embodiment shown.

There are naturally provided, equi-angularly spaced around the central axis A, two sets of jacks 61, one for screwing and one for unscrewing, the respective jack 61 being adapted to mesh with the toothed wheel 62 only when necessary.

In normal operation, that is to say to process standard type rods 13, the jacks 61 are moved away from the toothed wheel 60 or even demounted.

At rest the cams 18 are in the retracted position (FIG. 2).

In practice they then occupy an intermediate position between two extreme positions, respectively a screwing and an unscrewing position.

In this retracted position the cams 18 do not intrude significantly on the space 19 around the central axis A and the same applies to the gear 36 keyed to their shaft 35, the space left by the missing tooth of the gear 36 then facing the space 19.

It will be assumed that in the case of unscrewing the gears 43 keyed to the output shaft 44 of the motor-gearbox units 42 rotate clockwise as shown by the arrow F1 in FIG. 2.

This results in anticlockwise rotation as shown by the arrow F2 in FIG. 2 of the synchronizer ring 38 of the drive wrench 12E and clockwise rotation as shown by the arrow F3 in FIG. 2 of the cams 18.

Consequently, the cams 18 move from their retracted position shown in FIG. 2 to their deployed position shown in FIG. 4 in which their profile 28AH comes into contact with the rod 13 to be screwed, more precisely with the enlarged portion 14 of this rod 13.

Because of the shape of their profile 28AH and the resulting cross-bracing effect and because of the jaws 30 at the surface of the profile 28AH, the cams 18 of the drive wrench 12E then grip the rod 13 firmly between them without sliding in contact with it.

The drive wrench 12E being then immobilized against rotation by this rod 13 and the motor-gearbox units 42 continuing to operate, the carcass 11 (which until now has remained immobile) is caused by reaction to rotate clockwise, as diagrammatically represented by the arrow F4 in FIG. 2.

The carcass 11 driving the synchronizer ring 38 of the immobilizer wrench 12I through the radial fingers 48 of the latter in the opposite direction to the ring of the drive wrench, the cams 18 of the immobilizer wrench 12I pass in turn from their retracted position to a deployed position until they surround the enlarged portion 14 of the rod 13 underlying the previous rod in the jaws of the profile 28H.

From this time the drive wrench 12E is fastened in relation to the upper rod 13 and the immobilizer wrench 12I and with it the carcass 11 and the motor-gearbox units 42 carried by the latter are constrained to rotate with the lower rod 13.

The result of this in a first stage is to unlock the upper rod 13 from the lower rod 13 and in a second stage is to unscrew it from the latter.

However, if the torque developed by the motor-gearbox units 42 is insufficient to unlock the rods, the jacks 61 are used.

They then cause directly rotation relative to each other of the armatures 20 of the wrenches 12E, 12I by operating successively on one or more teeth of the respective toothed wheel 60 as diagrammatically shown in continuous and chain-dotted line in FIG. 5.

Operation is similar for screwing.

However, the cams 18 of the drive wrench then operate through their profile 28H.

In practice the rotation of the carcass 11 is over only a fraction of a turn in either case, namely that necessary to close upon the rod 13 to be immobilized the cams 18 of the immobilizer wrench 12I.

Because of this the motor-gearbox units 42 can advantageously be supplied direct by cables without the use of slip-rings.

More generally, the screwing and unscrewing machine 10 in accordance with the invention advantageously enables mechanical rotation of the drive wrench 12E by the several turns required without any rotary seal or other distributor of this kind. Of course, in the foregoing description it is assumed that the string of rods to be processed is appropriately suspended.

For example, it may be suspended by a safety device of the type used on all drilling installations.

Be this as it may, it will be noted that the screwing and unscrewing machine 10 in accordance with the invention may remain at the respective workstation at all times because the string of rods can be passed through it and because the lifting device required to offer up the rods to be screwed together or to remove the unscrewed rods can operate in its central space 19 when this central space 19 has been opened up by the cams 18 that it comprises.

Finally, it will have been understood that during unscrewing the drive wrench 12E driven by the upper rod 13 moves away from the immobilizer wrench 12I, taking with it the carcass 11 either, as shown, through the intermediary of the seal 47, optionally backed up by an annular ring (not shown) carried by the respective synchronizer ring 38 and limiting crushing of it, or, as a preferable alternative, by the intermediary of the rollers 26 which then cooperate with a second transverse shoulder (not shown) on the carcass 11 on the opposite side to them relative to a transverse shoulder 25.

The slots 50 in the carcass 11 then enable the latter to remain constrained to rotate with the synchronizer ring 38 of the immobilizer wrench 12I without escaping from the latter during its axial movement.

Likewise, during screwing, the drive wrench 12E moves towards the immobilizer wrench 12I and it must therefore be initially positioned accordingly.

The jacks 57 can be used if needed to adjust the height of the carcass 11 and therefore of the drive wrench 12E relative to the rod 13 to be screwed.

As an alternative, jacks may be provided under the baseplate 56 for this height adjustment.

On screwing, for example, the carcass 11 is raised using the jacks 57.

The drive wrench 12E is then carried by the carcass 11 through the intermediary of the rollers 26.

After it is clamped onto the upper rod 13 the jacks 57 are retracted.

The carcass 11 is lowered until it rests on the drive wrench 12E, as described above.

Of course, the drive wrench 12E must initially be positioned at a height sufficient for its vertical travel on screwing to remain less than that available between it and the immobilizer wrench 12I.

For unscrewing the jacks 57 are retracted.

The drive wrench 12E then rests on the immobilizer wrench 12I, for example through the intermediary of an annular ring (not shown) disposed between its bottom plate 22 and the top plate 22 of the immobilizer wrench 12I.

The carcass 11 then rests on the drive wrench 12E as previously explained.

In all cases, to enable use of ratchet type drive means, the drive wrench 12E must be in the lowered position for the toothed wheel 60 that it carries to be aligned with the jack(s) 61 carried by the immobilizer wrench 12I.

The jacks 57 can also be used if required to brake the carcass 11 so that when it is stopped the cams 18 of the immobilizer wrench 12I are in the retracted position.

The present invention is not limited to the embodiment described and shown but encompasses any variant execution thereof in particular with regard to the number, profile and constitution of the cams employed and the number of motor-gearbox units.

In the case of the cams in particular, their number and their profile represent a compromise between the necessity to deploy these cams without interfering with each other and maximum engagement of these cams on the rods to avoid damaging them.

Also, the motor-gearbox units constituting the drive means associated with the cams of the drive wrench can if required be replaced by an electromagnetic device.

For example, conductors fastened to the carcass and parallel to the axis may interact with a magnetic field fixed relative to the synchronizer ring of the drive wrench, developing a rotation torque between the carcass and this synchronizer ring.

For example, this magnetic field may be generated either by permanent magnets, which from the electrical point of view render the system similar to a synchronous motor, or to a stepper motor, with no shaft in this case, or by induced currents which from the electrical point of view render the system similar to an asynchronous motor.

Rotation is obtained by varying the direction of current flow in the conductors.

To render the carcass and the synchronizer ring coaxial it is then possible to provide on the armature of the drive wrench rollers cooperating with the inside cylindrical surface of the carcass.

Finally, the screwing and unscrewing machine in accordance with the invention as a whole may be supported by feet leaving under it all of the space needed to have access to the train of rods to be processed and to enable disposition there of the wedge device adapted to retain the rods.

It may also be provided with means adapted to allow it to be lifted, for example by jacks or on a cable.

It will have been noted that the two wrenches of the screwing and unscrewing machine in accordance with the invention bear one upon the other through the intermediary of the carcass in which they are staggered heightwise without bearing in operation on any other member external to the carcass.

The supporting baseplate to which the bottom immobilizer wrench is fastened is only to enable the assembly to be placed on any supporting surface.

The expression "motor-gearbox unit", which may be supplied with power by cable, must be understood as including electric motor-gearbox units.

Electric motor-gearbox units have the advantage of enabling precise control of the cams that they drive, namely control of the torque that they apply to a rod when they are engaged with a rod and control of their position when they are not engaged with a rod and/or of their speed when they are moved relative to a rod.

I claim:

1. Machine for screwing and unscrewing strings of rods comprising an annular carcass forming a frame about a central axis, upper and lower wrenches axially spaced on the carcass, the wrenches being adapted to grip two successive rods, one of said wrenches being a drive wrench mounted rotatably relative to the carcass and comprising a plurality of circumferentially spaced cams, each of said cams being pivotally mounted about an axis parallel to the central axis for movement between a retracted position in which a sufficient space is defined around the central axis to permit the passage of the rods and a deployed position in which the cams encroach of the space to grip a rod located therein, and said carcass being rotatably interconnectable between said wrenches.

2. Machine according to claim 1, wherein the cams of the drive wrench are carried by an armature rotatable in the carcass.

3. Machine according to claim 2, wherein said armature has a plurality of peripheral arms for bearing on an annular shoulder provided on the carcass.

4. Machine according to claim 2, wherein said armature comprises two spaced parallel annular plates which are appropriately cross-braced, the cams being disposed between said plates.

5. Machine according to claim 1, wherein each of said cams of the drive wrench comprises a plurality of jaws spaced on an operative surface thereof, said jaws being pivotable about axes parallel to the respective pivot axes of the cams.

6. Machine according to claim 5, wherein the operative surface of each of said cams of the drive wrench is such that, whatever the diameter of the rod to be gripped, a point of contact with the rod is in the vicinity of the center line joining its pivot axis to the central axis.

7. Machine according to claim 1, wherein each of the cams of the drive wrench has two symmetrical operative surfaces, one of the operative surfaces being for screwing and the other being for unscrewing.

8. Machine according to claim 1, wherein each of the cams of the drive wrench meshes through a gear with a synchronizer ring disposed annularly around the central axis and common to all of said cams.

9. Machine according to claim 8, wherein the cams of the drive wrench are associated with drive means for moving them from the retracted position to the deployed position.

10. Machine according to claim 9, wherein said drive means comprise a plurality of motor-gearbox units spaced around the central axis carried by the carcass, and each of the motor-gearbox units meshes through a gear constrained to rotate with an associated output shaft with the synchronizer ring of the cams.

11. Machine according to claim 10, wherein said motor-gearbox units are disposed on the side of the drive wrench opposite to the other of said wrenches.

12. Machine according to claim 11, wherein the other of said wrenches is an immobilizer wrench having a construction similar to that of the drive wrench.

13. Machine according to claim 20, wherein each of the cams of the drive wrench meshes through a gear with a synchronizer ring disposed annularly around the central axis and common to all of said cams, and other of said wrenches is an immobilizer wrench having a construction similar to that of the drive wrench, the synchronizer ring of the cams of the immobilizer wrench being constrained to rotate with the carcass.

14. Machine according to claim 1, wherein ratchet type drive means are provided between the wrenches.

15. Machine according to claim 14, wherein each of the two wrenches comprises an armature, the cams of each wrench being pivotally mounted, said drive means comprising a toothed wheel fastened to the armature of one of the wrenches and at least one actuator having two components, one of the components of the actuator being articulated to the armature of the other wrench and the other of the components of the actuator being adapted to mesh with said toothed wheel.

16. Machine according to claim 1, wherein the drive wrench is the upper wrench.

17. Machine according to claim 1, wherein the lower wrench comprises a mount.

18. Machine according to claim 17, wherein said mount is fastened to a fixed baseplate which carries a plurality of actuators spaced around the central axis and adapted to cooperate with the carcass.

19. Machine according to claim 9, wherein said drive means comprise an electromagnetic device, the carcass and the synchronizer ring respectively comprising stator and rotor members of said electromagnetic device.

20. Machine for screwing and unscrewing strings of rods comprising an annular carcass forming a frame about a central axis, upper and lower wrenches axially spaced on the carcass, the wrenches being adapted to grip two successive rods, one of said wrenches being a drive wrench mounted rotatably relative to the carcass and comprising a plurality of circumferentially spaced cams, each of said cams being pivotally mounted about an axis parallel to the central axis for movement between a retracted position in which a sufficient space is defined around the central axis to permit the passage of the rods and a deployed position in which the cams encroach of the space to grip a rod located therein, ratchet type drive means being operatively disposed between the wrenches.

21. Machine for screwing and unscrewing strings of rods comprising an annular carcass forming a frame about a central axis, upper and lower wrenches axially spaced on the carcass, the wrenches being adapted to grip two successive rods, one of said wrenches being a drive wrench mounted rotatably relative to the carcass and comprising a plurality of circumferentially spaced cams, each of said cams being pivotally mounted about an axis parallel to the central axis for movement between a retracted position in which a sufficient space is defined around the central axis to permit the passage of the rods and a deployed position in which the cams encroach of the space to grip a rod located therein, the lower wrench comprising a mount, wherein said mount is fastened to a fixed baseplate which carries a plurality of actuators spaced around the central axis and adapted to cooperate with the carcass.

22. Machine according to claim 21, wherein each of the cams of the drive wrench meshes through a gear with a synchronizer ring disposed annularly around the central axis and common to all of said cams, said cams of the drive wrench being associated with drive means for moving them from the retracted position to the deployed position, said drive means comprising an electromagnetic device, and the carcass and the synchronizer ring respectively comprising stator and rotor members of said electromagnetic device.

23. Machine for screwing and unscrewing strings of rods comprising an annular carcass forming a frame about a central axis upper and lower wrenches axially spaced on the carcass, the wrenches being adapted to grip two successive rods, one of said wrenches being a drive wrench mounted rotatably relative to the carcass and comprising a plurality of circumferentially spaced cams, each of said cams being pivotally mounted about an axis parallel to the central axis for movement between a retracted position in which a sufficient space is defined around the central axis to permit the passage of the rods and a deployed position in which the cams encroach on the space to grip a rod located therein, each of the cams of the drive wrench meshing through a gear with a synchronizer ring disposed annularly around the central axis (A) and common to all of said cams, and the other of said wrenches being an immobilizer wrench having a construction similar to that of the drive wrench, the synchronizer ring of the cams of the immobilizer wrench being constrained to rotate with the carcass.

24. Machine according to claim 23, wherein ratchet type drive means are provided between the wrenches.

25. Machine according to claim 24, wherein each of the two wrenches comprises an armature, the cams of each wrench being pivotally mounted, said drive means comprising a toothed wheel fastened to the armature of one of the wrenches and at least one actuator having two components, one of the components of the actuator being articulated to the armature of the other wrench and the other of the components of the actuator being adapted to mesh with said toothed wheel.

* * * * *